US006758580B1

(12) United States Patent
Verfuerth

(10) Patent No.: US 6,758,580 B1
(45) Date of Patent: Jul. 6, 2004

(54) FLUORESCENT HANGING LIGHT FIXTURE

(76) Inventor: Neal R. Verfuerth, 642 Western Ave., Random Lake, WI (US) 53075

( * ) Notice: Subject to any disclaimer, the term of this patent is extended or adjusted under 35 U.S.C. 154(b) by 50 days.

(21) Appl. No.: 10/086,820

(22) Filed: Mar. 4, 2002

Related U.S. Application Data

(63) Continuation-in-part of application No. 09/870,976, filed on Jun. 1, 2001, now Pat. No. 6,585,396.

(51) Int. Cl.[7] ..... F21V 7/00

(52) U.S. Cl. ..... 362/241; 362/221; 362/225; 362/260

(58) Field of Search ..... 362/221, 225, 362/241, 260

(56) References Cited

U.S. PATENT DOCUMENTS 4,435,744 A * 3/1984 Russo ..... 362/260

* cited by examiner

*Primary Examiner*—Stephen F. Husar

(74) *Attorney, Agent, or Firm*—Robert T. Johnson

(57) ABSTRACT

Disclosure is made of a fluorescent elongated light fixture having a plurality of elongated light reflectors and each end of the light reflectors attached to socket mount/wire raceway arms attached to ends of ballast channel assembly and sockets for a plurality of fluorescent, elongated light tubes mounted on socket mount/wire raceway arms at each end of the longitudinal light reflectors on the concave side, and a plurality of fluorescent light tubes inserted into the fluorescent light tube sockets on the concave side of the light reflectors and one ballast in the ballast channel, and the reflectors having a cross section of a parabola and rim edges bent outward on each edge of the reflectors, and the rim edges of the reflectors overlapping the adjacent rim on assembly of the light fixture.

5 Claims, 9 Drawing Sheets

Figure 1:
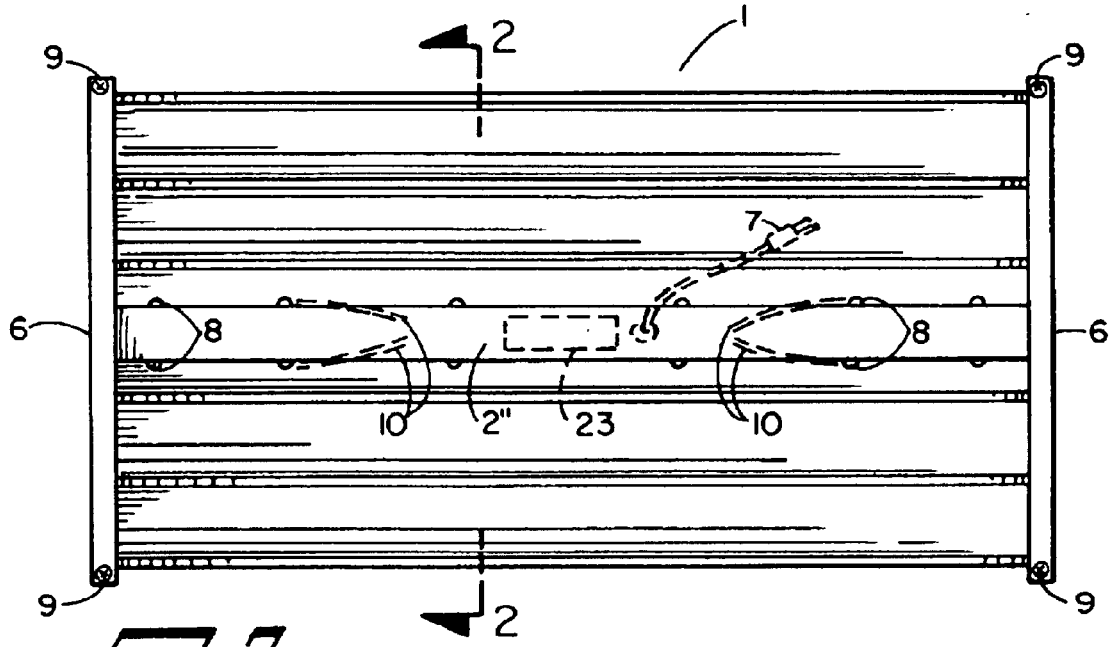

W = 2xD
S = 0.5xD
d = .375xD
R' = .875xD
ARC= 160° d = .375xD
d' = 3.25xD
C = 0.5xD
ARC= 120°

FLUORESCENT HANGING LIGHT FIXTURE

This application under 37 CFR 1.53 (b,2) is a continuation-in-part of Ser. No. 09/870,976, filed Jun. 1, 2001, for FLUORESCENT HANGING LIGHT FIXTURE, having the same inventor, now U.S. Pat. No. 6,585,396.

BACKGROUND OF THE INVENTION

Fluorescent hanging light fixtures, up to the present have a shroud fastened to the ceiling, or are mounted in recessed openings in the ceiling, and the ballast is mounted in the concave side of the shroud. This present invention discloses a hangable fluorescent light fixture with elongated fluorescent light tubes, mounted on the concave side of elongated reflectors and the elongated reflectors attached to socket mount/wire raceway arms of the fluorescent light fixture frame.

SUMMARY OF THE INVENTION

Disclosure is made of a fluorescent light fixture 1, having elongated light reflectors 4, and each end of the light reflectors 4, attached to socket mount/wire raceway arms 6, attached to ends of ballast channel assembly 2, and sockets 5, for elongated fluorescent light tubes. 3 mounted on socket mount/wire raceway arms 6 at each end of the elongated light reflectors 4 on the concave side, and elongated fluorescent light tubes 3, inserted into fluorescent light tube sockets 5 on the concave side 4" of the elongated light reflectors 4, and the elongated light reflectors 4 having a parabolic shape in cross section, to control down light In the following specification and claims the terms "light reflectors" and "fluorescent light tubes" includes "elongated light reflectors" and "elongated fluorescent light tubes", identified as linear fluorescent bi-pin tubes.

An object of this invention of a fluorescent light fixture assembly 1 including a fluorescent light fixture frame 12 a ballast channel assembly 2 and socket mount/wire raceway arms 6, attached to the ballast channel assembly 2 and fluorescent light reflectors 4, attached to the socket mount/wire raceway arms 6, and fluorescent fixture tube shunted sockets 5, 5' attached to the socket mount/wire raceway arms 6, and the fluorescent fixture tube sockets 5, 5' located under each end of the fluorescent light reflectors 4, and fluorescent dual pin light tubes 3, inserted into the fluorescent fixture tube shunted sockets 5, 5' under the reflectors 4, and an electric power source 7 into the light fixture assembly and a switch on/off 20 mounted on the ballast channel assembly, and the power connected to the ballast 23 components mounted in the ballast channel assembly 2.

Another object is to disclose elongated fluorescent light reflectors of new geometry and assembly to better reflect elongated fluorescent tube light downward.

Another object is to disclose a fluorescent light tube assembly having a plurality of eight elongated fluorescent light tubes aligned parallel side by side in an assembled fluorescent light fixture, and an elongated reflector over each of the elongated fluorescent tube lights, and only one ballast for a total plurality of at least two to eight elongated fluorescent light tubes in the light fixture.

Another object of this invention is to disclose rim edges, bent outwards, on edges of elongated light reflectors having a cross section of a modified inverted U.

PRIOR ART

The following U.S. Patents are cited as prior art.

U.S. Pat. No. 2,619,583 to BAUMGARTNER for LUMINAIRE FOR ELONGATED LAMPS. This patent discloses a housing over the back of the reflectors U.S. Pat. No. 3,247,368 to McHUGH for FLUORESCENT LIGHTING FIXTURE. This discloses the lights grouped under a hood and does not include individual reflectors.

U.S. Pat. No. 4,674,015 to SMITH for FLUORESCENT LIGHT FIXTURE WITH REMOVABLE BALLAST. Disclosure is made of a plug in ballast on the spine of the fixture.

U.S. Pat. No. 4,814,954 to SPITZ for RIGID LIGHTWEIGHT FLUORESCENT FIXTURE. Disclosure is made of a reflector positioned between double walled end panels, which are connected to one another by a double walled elongated box like structure.

U.S. Pat. No. 4,928,209 to RODIN for LIGHTING APPARATUS. This patent discloses a reflector, having tube hangers one reflector for each pair of tubes, and the reflectors mounted in a cover.

U.S. Pat. No. 5,062,030 to FIGUEROA for CUSTOMIZED LIGHT REFLECTOR. This patent discloses reflectors mounted in existing fixtures.

U.S. Pat. No. 5,192,129 to FIGUEROA for CUSTOMIZED LIGHT REFLECTOR. This patent discloses light reflecting planes installed in a lighting fixture.

BRIEF DESCRIPTIONS OF DRAWINGS

FIG. 1—Top plan view.

Figure 2:
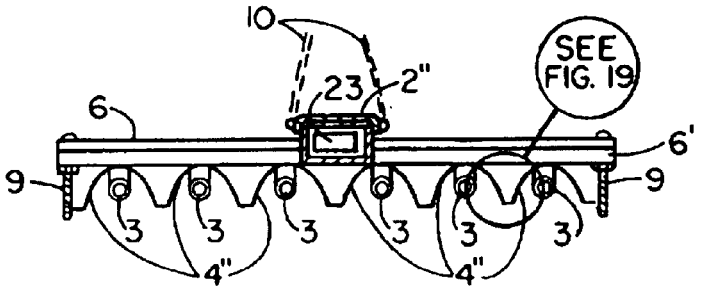

FIG. 2—Cross section of fixture.

Figure 3:
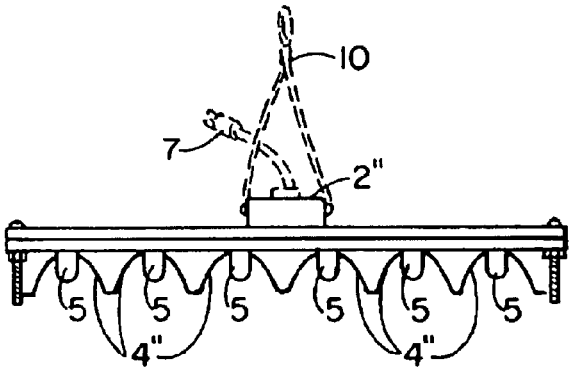

FIG. 3—End elevation view.

Figure 4:
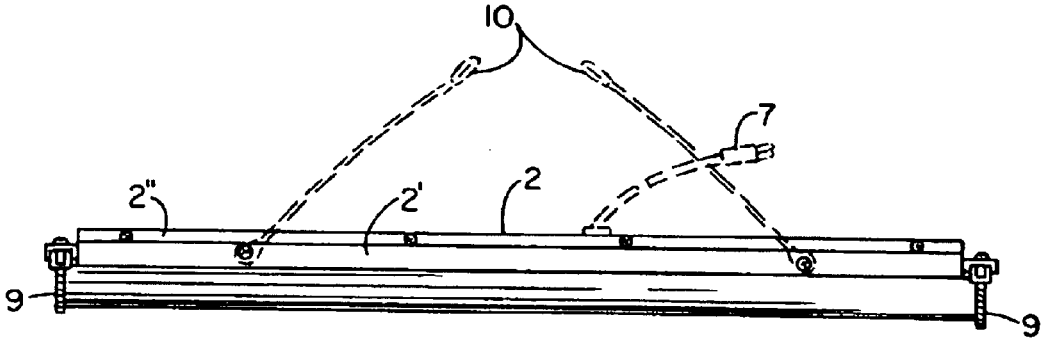

FIG. 4—Front elevation view.

Figure 5:
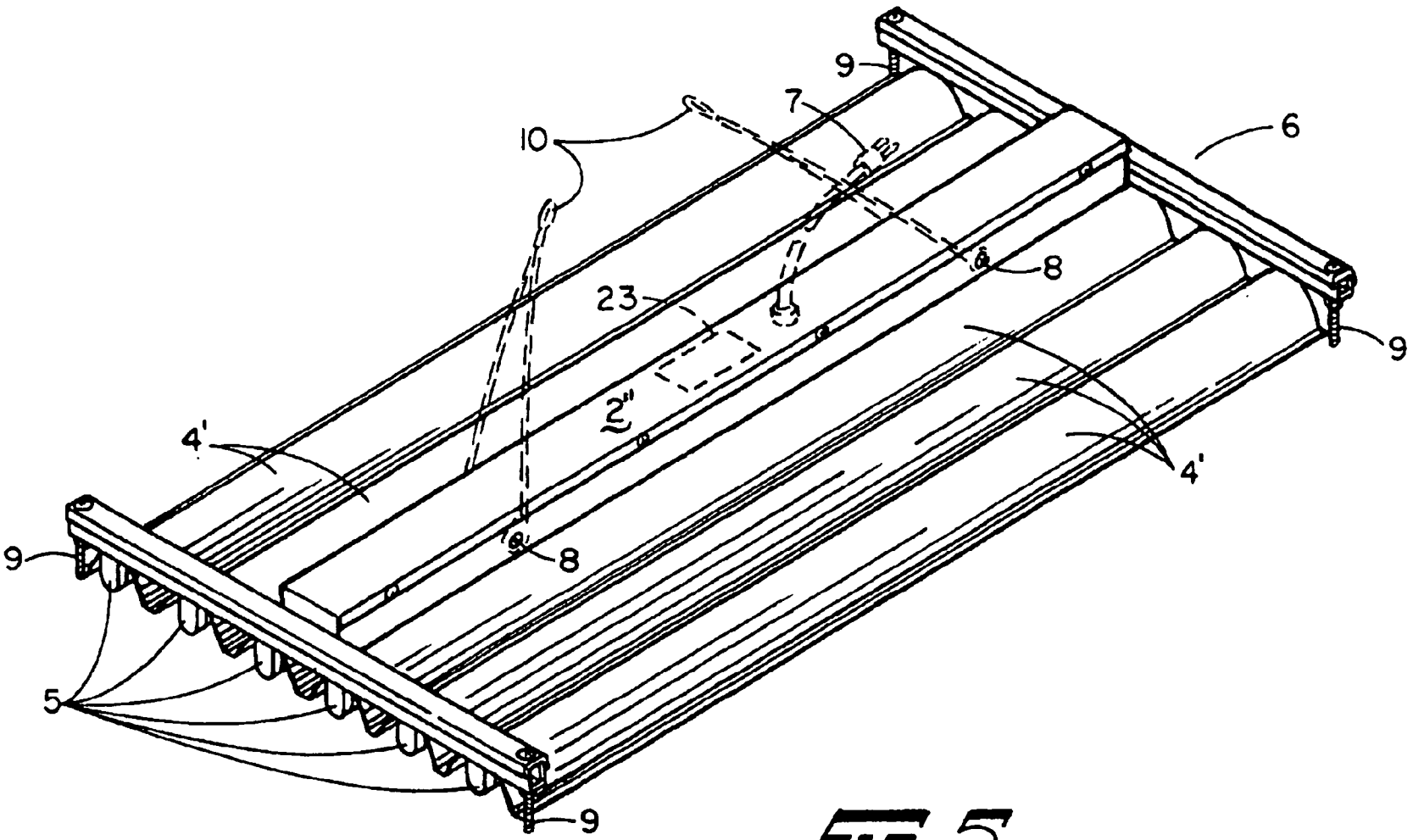

FIG. 5—Perspective view.

Figure 6:
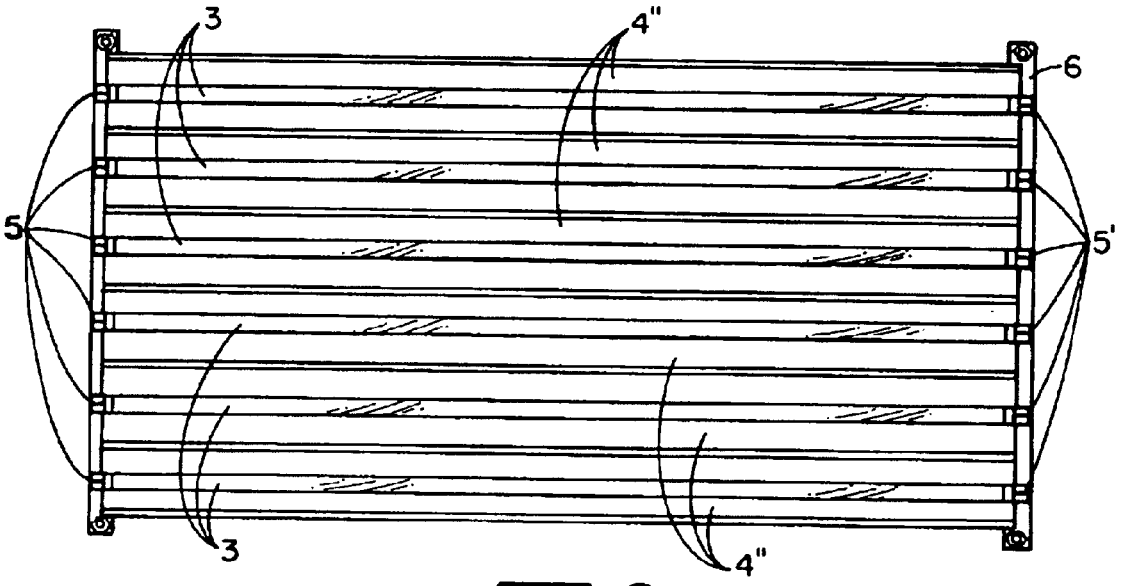

FIG. 6—Bottom plan view.

Figure 7:
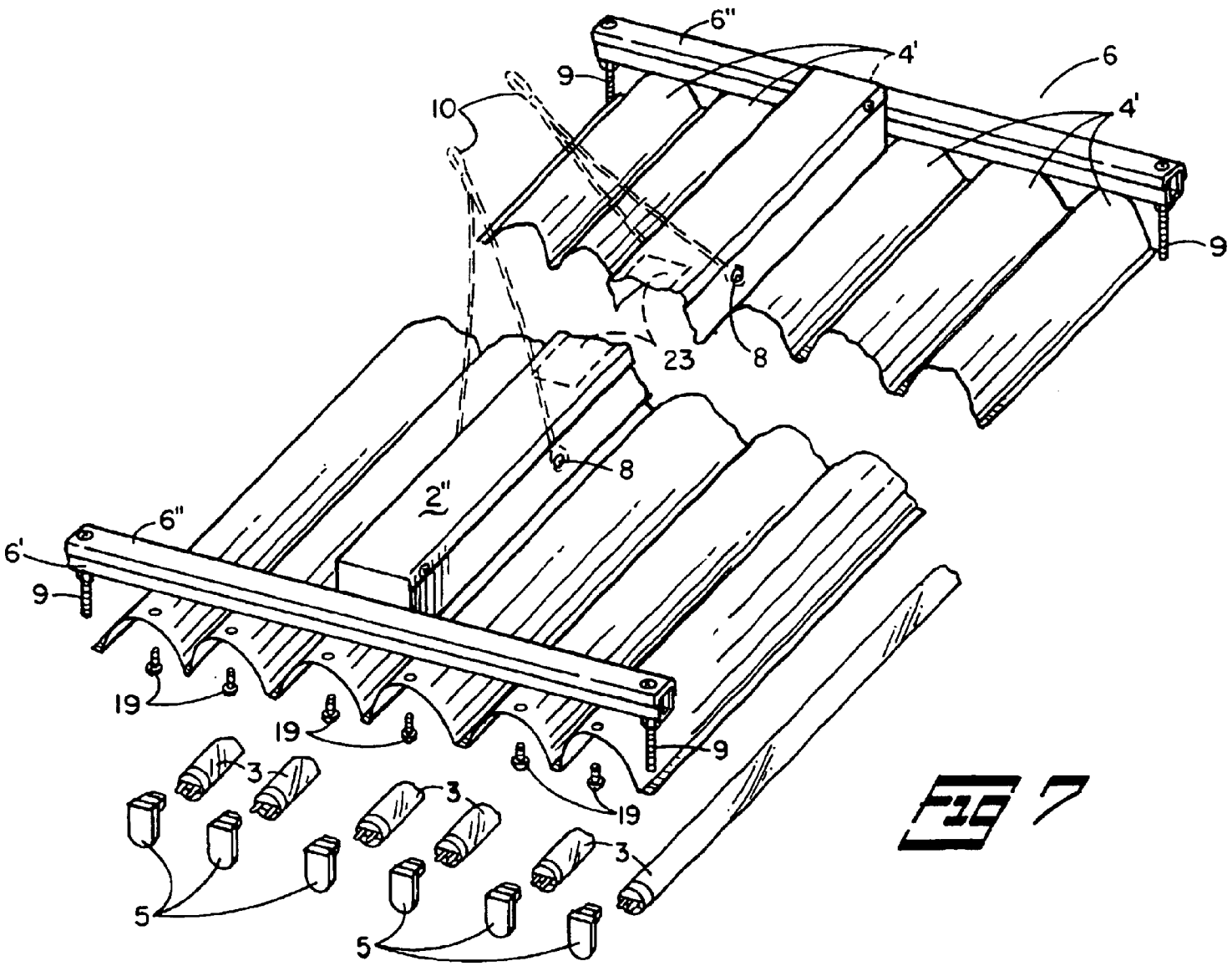

FIG. 7—Perspective view of fluorescent light fixture assembly.

Figures 8, 9:
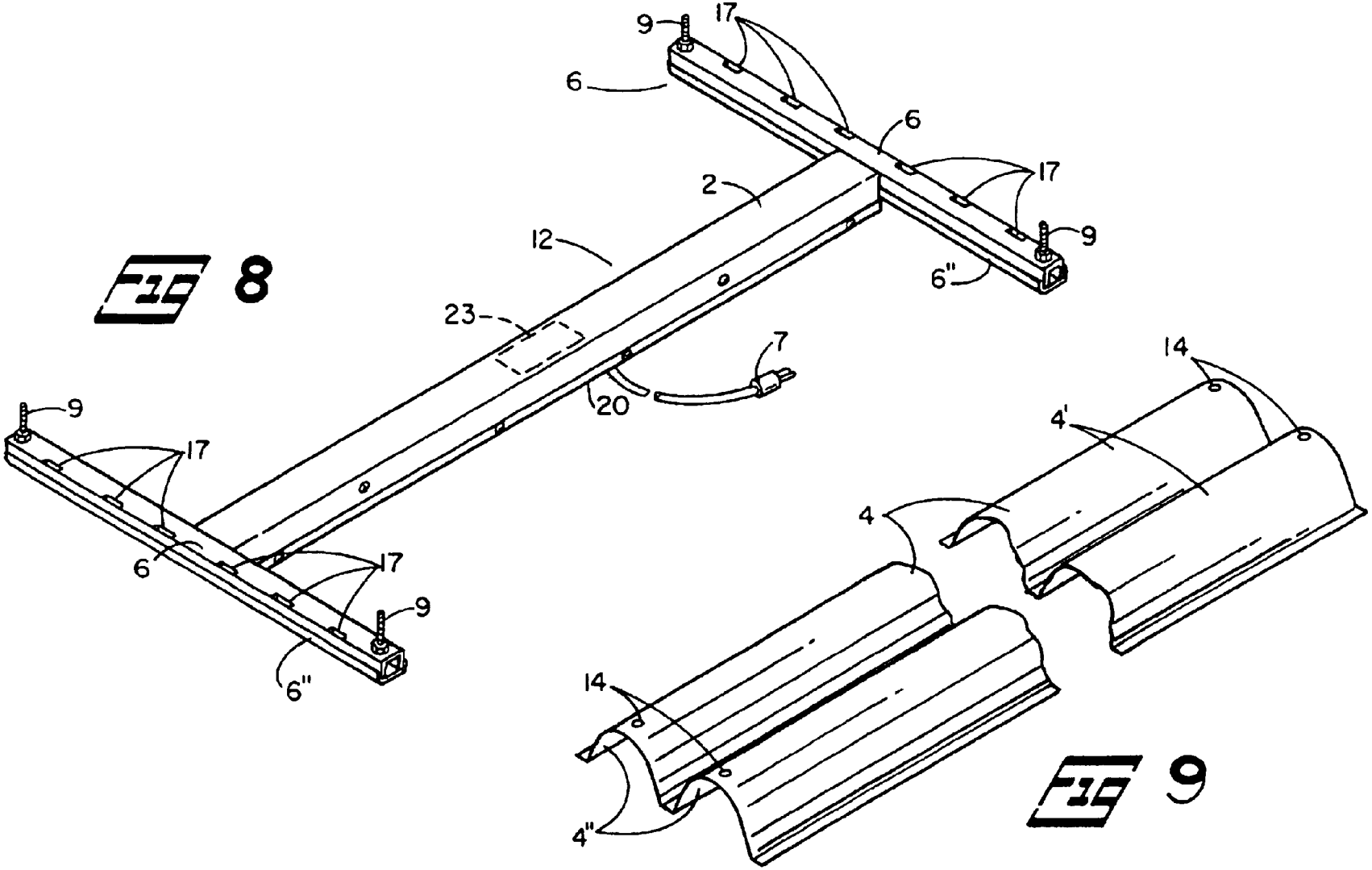

FIG. 8—Fluorescent light fixture frame.

FIG. 9—Perspective view of fluorescent light reflectors.

Figure 10:
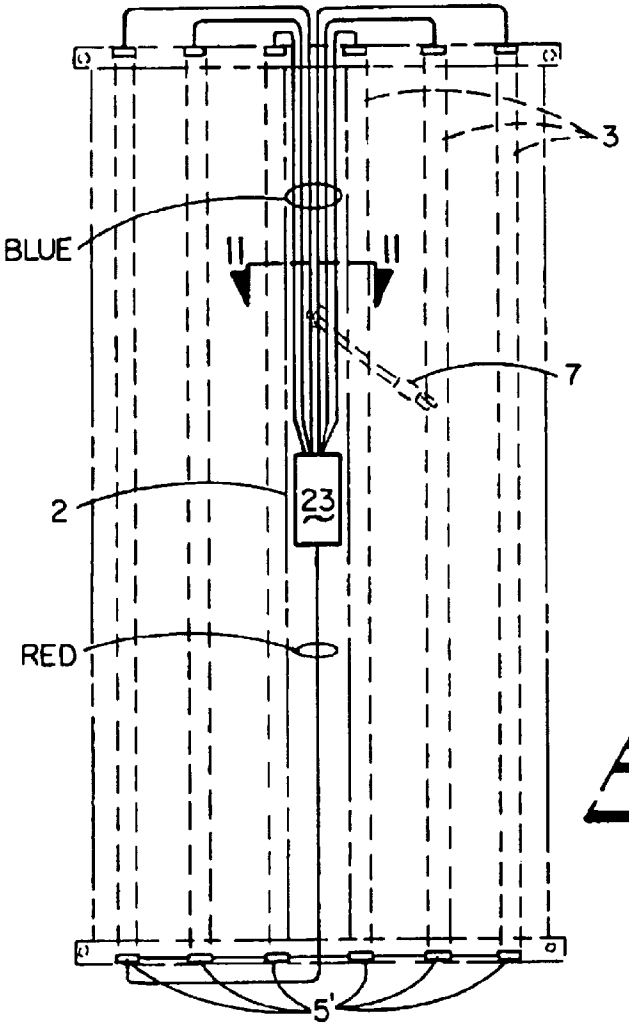

FIG. 10—Wiring diagram of fluorescent light fixture frame.

Figure 11:
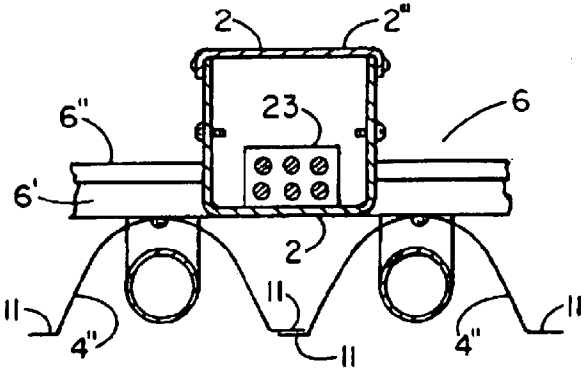

FIG. 11—Cross section of ballast channel.

Figure 12:
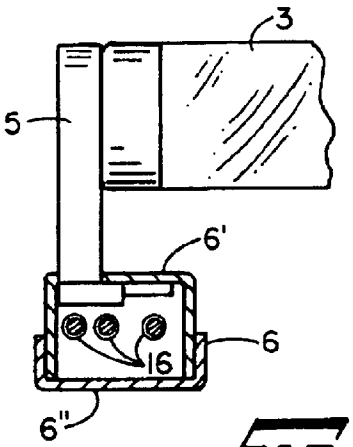

FIG. 12—Cross section of socket mount arm wire raceway

Figure 13:
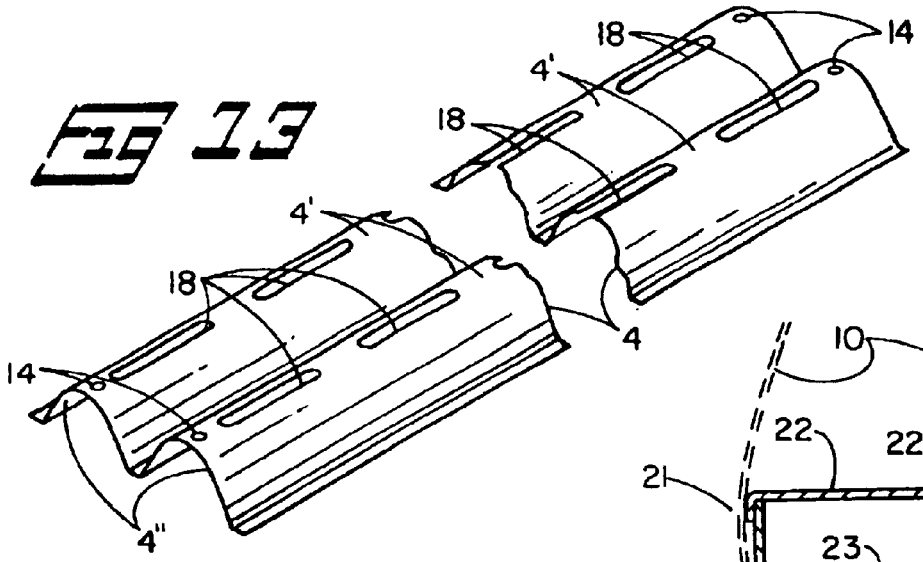

FIG. 13—Reflector segments with slots.

Figure 14:
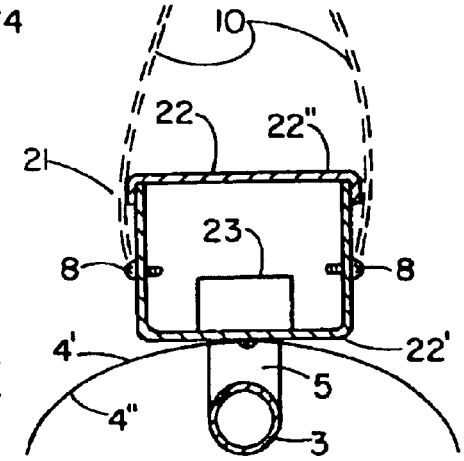

FIG. 14—Cross section of single reflector fixture.

Figure 15:
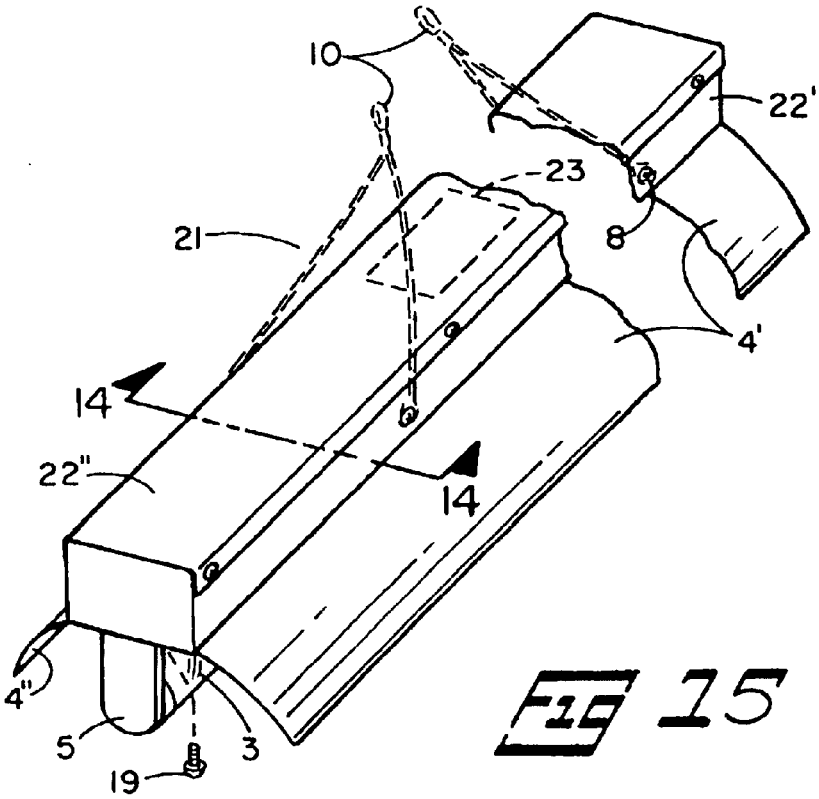
Figure 7:
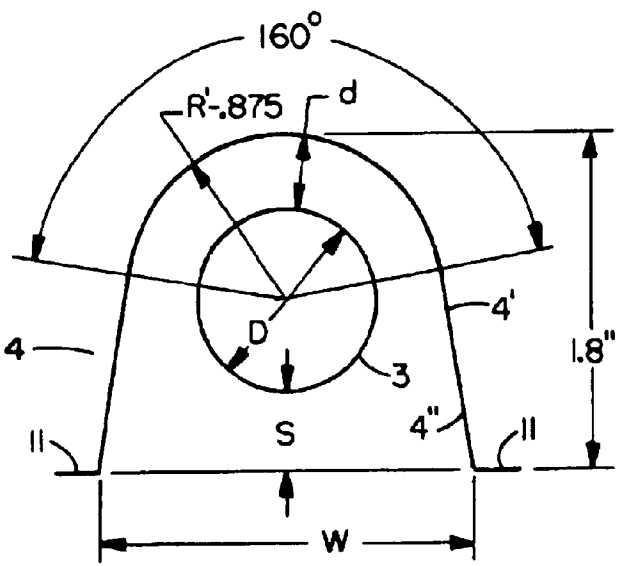
Figure 6:
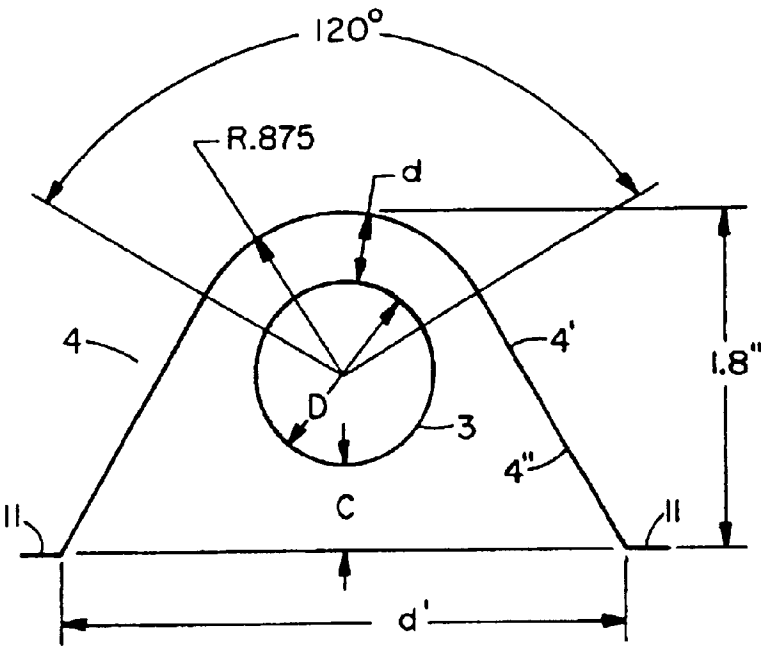

FIG. 15—Perspective view of single reflector light fixture assembly.

FIG. 16—Cross section view of geometry of fluorescent tube light reflector.

FIG. 17—Cross section view of alternate geometry of fluorescent tube light reflector.

Figure 18:
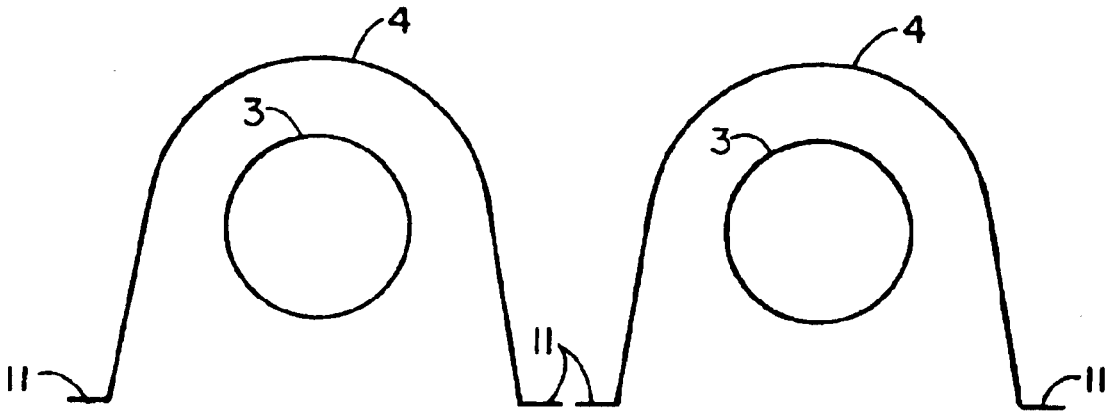

FIG. 18—Magnified cross section exploded view of fluorescent reflectors before assembly.

Figure 19:
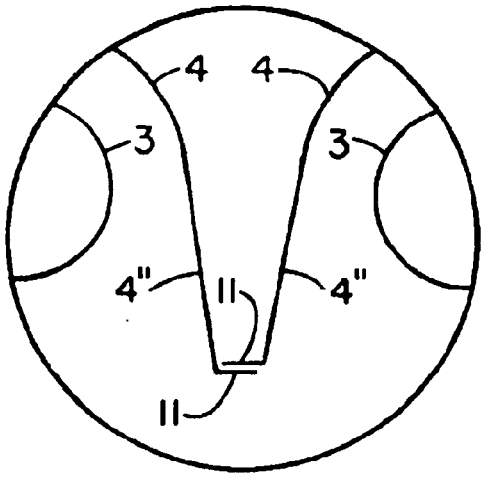

FIG. 19—Magnified cross section view of fluorescent reflectors adjoining on being assembled in light fixture.

LEGENDS OF DRAWINGS

| LEGEND | DESCRIPTION |
|---|---|
| 1 | Top plan view of assembled fluorescent light fixture. |
| 2, | Ballast channel assembly. |
| 2', | Ballast channel bottom. |
| 2" | Ballast channel cover. |
| 3 | Fluorescent light tubes. |
| 4 | Fluorescent light tube reflectors. |
| 4' | Convex side of reflectors. |
| 4" | Light reflector channels/concave side of reflectors. |
| 5 | Fluorescent fixture tube sockets. |
| 5' | Fluorescent fixture tube sockets, connected in series |
| 6 | Socket mount/wire raceway arms. |
| 6' | Bottom section of channel socket mount/wire raceway arm. |
| 6" | Top cover section of channel socket mount/wire raceway arm. |
| 7 | Electric power source into the light fixture assembly apparatus. |
| 8 | Hanger mounts. |
| 9 | Screw mounts. |
| 10 | Hanger wire/chain. |
| 11 | Rim edges on length of fluorescent light reflectors. |
| 12 | Fluorescent light fixture frame. |
| 13 | Anchor rivets, bolts or screws for attachment of light reflectors to socket mount arms. |
| 14 | Apertures for fasteners attaching reflectors to socket mount arms. |
| 15 | Fasteners for attaching top of ballast channel to ballast channel bottom. |
| 16 | Wires in arms of fixture frame. |
| 17 | Aperture slots for insertion of snap fit fluorescent light tube sockets. |
| 18 | Slots in reflectors. |
| 19 | Fasteners to attach reflectors to socket mount arms. |
| 20 | Switch on/off. |
| 21 | Single fluorescent light tube fixture. |
| 22 | Ballast channel assembly for single fluorescent light tube. |
| 22' | Ballast channel bottom for single fluorescent light tube. |
| 22" | Ballast channel assembly for cover fluorescent light tube. |
| 23 | Ballast |
| D | Diameter of fluorescent light tube. FIG. 16 |
| d | Distance between top surface of fluorescent light tube and arc of reflector. FIG. 16. |
| d' | Distance between edges of reflector. FIG. 16 |
| c | Distance from bottom of fluorescent light tube to line extending from edge to edge of reflector. FIG. 16. |
| R | Radius of arc of reflector. FIG. 16. |
| H | Height of reflector. FIG. 16 |
| W | Distance between edges of reflector. FIG. 17. |
| R' | Radius of arc of reflector. FIG. 17. |
| Ht | Height of reflector. FIG. 17. |
| S | Distance from bottom of fluorescent light tube to line extending from edge to edge of reflector. FIG. 17. |
| T | Distance between top surface of fluorescent light tube and arc of reflector. FIG. 17 |
| Blue | Individual wires for one end of each fluorescent light tube sockets 5. |
| Red | One wire from ballast to fluorescent light tube sockets connected in series 5' |

DETAILED DESCRIPTION

The disclosure of this invention includes mounting of a plurality of elongated fluorescent light tubes in a plurality of elongated reflectors,and a ballast mounted in the assembled elongated fluorescent light fixture.

The invention described herein discloses a fluorescent light fixture apparatus having downlight and suspended from the ceiling; and each fluorescent tube light mounted in its own reflector 4 for maximum "down light", and each reflector 4 attached to fluorescent light fixture frame 12. The fluorescent light fixture apparatus may be for direct down-light or semi-direct, in which case there may be slots in the top surface of the reflectors. (see sec. 12, page 169 in "STANDARD HANDBOOK FOR MECHANICAL ENGINEERS" by BAUMEISTER and MARKS (seventh edition)

The fluorescent light fixture 1, top plan view FIG. 1 apparatus of this invention varies from the prior art, in that in this invention, each fluorescent light tube 3, (FIGS. 2, 5, 6 and 7) in the fixture assembly 1, (FIGS. 6, 7) is mounted in its own light reflector channel 4" (FIGS. 2, 3, & 6), on the concave side 4" of the reflector 4 (FIG. 9). The light reflectors 4, are attached to the socket mount/wire raceway arms 6 , by anchor rivets,bolts or screws 13, at each end of the light reflector channels 4".see FIG. 7. Fluorescent fixture tube shunted sockets 5 are mounted in aperture slots 17, for insertion and snap fit of fluorescent tube sockets 5 on the socket mount/wire raceway arms 6 (FIGS. 3, 5, & 6) of assembled fluorescent light fixture apparatus.

Referring now to fluorescent light fixture frame 12 (FIG.8) showing a plan view of a figure H shape, with arms 6 extending outward and perpendicular to the ends of ballast channel assembly 2. and in each socket mount/wire raceway arm 6, apertures 17 for insertion of snap fit fluorescent fixture tube shunted sockets 5 and 5'. Ballast 23, for the fluorescent light tubes 3, is mounted in the ballast channel assembly 2 and electric power source 7 into light fixture apparatus 1, and a switch 20 for on/off of the power from the power line 7 to the ballast 23 in the ballast channel assembly 2.

The ballast channel assembly 2, may be likened to a spine, attached to the socket mount/wire raceway arms 6.

FIG. 7 is a perspective view of assembly components of the fluorescent light fixture of this invention, with the light reflectors 4, attached to the socket mount/wire raceway arms 6 by fasteners 19.

FIG. 9 shows isolated light reflectors 4 and apertures 14 for fasteners to attach reflectors to socket mount arms 6.

FIG. 13 shows reflectors having slots 18 in reflectors thus the "light" of the fixtures in addition to having the light go downward the light can also go upwards, but in a lesser amount.

FIG. 14 is a cross-section view of a single fluorescent light fixture, and a single reflector 4, and ballast 23 mounted in ballast mounting channel assembly 22, and showing ballast channel bottom 22' and ballast channel cover 22" fitting over the ballast channel bottom 22'.

FIG. 15 is a perspective view of a single fluorescent light fixture 21, and the ballast 23 mounted in ballast channel assembly 2.

Cross section view of socket mount/wire raceway arm 6 is shown in FIG. 12, and the arms 6 are assembled from bottom section channel of socket mount/wire raceway 6' and top cover channel section of socket mount/wire raceway 6", fitting together lengthwise and held in position by suitable screws or rivets to provide the socket mount/wire raceway arm 6, and wires 16, in arms 6 of fluorescent light fixture frame 12, (see FIG. 8) assembly.

Referring now to FIG. 10, the wiring schematic is shown and the ballast 23 is shown mounted in ballast channel assembly 2, and as shown in FIG. 11, is an assembly of a ballast channel bottom 2', and a ballast channel cover 2" fitting lengthwise over ballast channel bottom 2' and this assembly held together by conventional screws 15.

The electric power source 7 into the light fixture apparatus and on/off switch 20 connected to the power source is shown in FIGS. 1, 3.

The Fluorescent light fixture 1, may hang from a ceiling on hanger wire/chain 10 attached to hanger mounts 8, or to screw mounts 9.

Reference is now made to FIG. 8, fluorescent light fixture frame 12 and the fluorescent light tube reflectors 4, are mounted on the fixture frame 12, as shown in FIG. 7 perspective view of fluorescent light fixture assembly, and the rim edges 11 on each long edge of each reflector 4, and on assembly of the reflectors 4 on the light fixture frame 12, the rim edges 11 of the reflectors 4 overlap as shown in FIG. 19 to give added stability or rigidity to the assembled light fixture. Reference is now made to FIGS. 16, 17, and 18 showing cross section of rim edges 11 of elongated reflector edge rims 11.

The following is a description of the cross section geometry of light reflectors 4, to insure maximum light reflection downward from the fluorescent light tubes 3. Referring to FIG. 16, wherein it is shown the fluorescent tube 3, having a diameter D, then the radius R of the bend of the reflector 4 is D×0.875, and the arc at the bend of the reflector is equal to 120°, and reflector sides are tangent to the radius at the ends of the arc, and these reflector sides extend outward to a dimension d' equal to 3.25×D, between the edges of the reflector 4, and the distance d between the fluorescent light tube 3 and the arc of the bend of the light reflector is 0.375×D. The distance C is equal to 0.5×D.

Reference is now made to FIG. 17, in which the cross section of reflectors 4 is shown, and the parabola shape compared to FIG. 16, is to reduce the dispersion of light out of the sides of the fluorescent light fixture assembly 1. The reflectors 4 of FIG. 17 are described as the fluorescent light tube 3, having a diameter D, then the radius R' of the bend of the reflector 4 is D×0.875, and the arc at the bend of the reflector is equal to 160°, and the sides of reflector 4, are tangent to the radius at the ends of the arc, and these sides of reflectors 4 extend out-ward to a dimension W equal to 2×D, between edges of reflector 4 sides. The distance d between the top of fluorescent light tube 3, and the arc of the reflector is equal to 0.375×D.

Note the height of the arc of reflector 4, as shown in FIGS. 16 and 17, is 1.8" which is approximate height to indicate possible scale, and may be more or less as desired.

The distance S, between the bottom of the fluorescent light tube 3, and the line W between the edges of reflector 4, is equal to 0.25×D.

In all of the above description and formulas, the "X" stands for "multiplication" or "times".

Comparing FIGS. 16 and 17, it is readily seen that shortening "W" as shown in FIG. 17 then will focus light downward with less light then extending out of the sides of the fixture assembly 1, thus this invention discloses a method to control light downward in a fluorescent light fixture.

The method of focusing downlight of a fluorescent hanging light fixture 1 by reflectors 4 over each fluorescent light tube 3, a reflector 4 extending the length of the fluorescent light tube 4, and the cross section of the reflector 4, is an arc straddling the fluorescent light tube 3 and a space of 0.375 times diameter of the fluorescent light tube 3 from the fluorescent light tube 3 and the arc of the reflector 4 having a radius of 0.875 times the diameter of the fluorescent light tube 3 and the arc ranging from 120° to 160° and the sides of the reflector 4, tangent at each end of arc range of reflector 4.

The reflector 4, of this invention may be of polished sheet metal or metal coated plastic, or metal coated glass.

To further describe the elongated reflectors 4 of this invention, in cross section the shape is a modified inverted U, and the two edges of the elongated reflectors are bent outwards to form rim edges 11, on the length of each edge see FIGS. 16, 17 and 18. The rim edges 11 overlap as shown in FIG. 19 on assembly of the fluorescent light fixture.

The specification and drawings disclose a fixture apparatus having six elongated reflectors, and six elongated fluorescent light tubes but this invention is not limited to that number, and includes any number of elongated reflectors and elongated fluorescent light tubes of from two to a total of eight reflectors and eight fluorescent light tubes and one ballast in the assembly.

Reference is made to FIG. 4, front elevational view of assembled fluorescent light fixture, and FIG. 10 is a plan view of the light fixture and schematic of the wiring from the ballast 23 to the fluorescent light sockets with the single wire Red from the ballast to the sockets 5' connected in series, and a single Blue wire from the ballast 23 to each of the sockets 5.

I claim:

1. Fluorescent light fixture comprising:

a—a plurality of elongated light reflectors and each end of said elongated light reflectors attached to socket mount/wire raceway arms and b—said socket mount/wire raceway arms attached to ends of ballast channel assembly, c—a single ballast mounted in said ballast channel assembly, d—fluorescent light tube sockets for a plurality of fluorescent light tubes mounted on said socket mount/wire raceway arms at each end of said elongated light reflectors in the concave side of said elongated light reflectors e—a plurality of said elongated fluorescent light tubes inserted into said fluorescent light tube sockets in the concave side of said elongated light reflectors and, f—rim edges on said elongated light reflectors over-lap on adjacent rim edges of said elongated light reflectors.

2. A fluorescent elongated tube light fixture, of claim 1, wherein further improvement consists of:

a—said elongated light reflectors fitting over said elongated fluorescent light tubes for maximum light, reflection downward, b—said elongated fluorescent tube lights having a diameter D, then the radius R of the bend of the cross section of said elongated light reflectors is D×0.875, c—an arc at said bend of said elongated light reflectors is equal to 120°, d—the side of said elongated light reflectors are tangent to said radius at the ends of said arc, e—said elongated light reflectors sides extend outward to a dimension between sides said elongated light reflectors sides equal to 3.25× the diameter of the said elongated fluorescent light tube and, f—the distance between said elongated fluorescent light tube and said arc of the bend of said light reflector is equal to 0.375× diameter of said elongated fluorescent tube light and, g—distance from bottom of said elongated fluorescent light tube to span line between side edges of said elongated light reflector is equal to 0.5× diameter of said elongated fluorescent light tube.

3. Elongated light reflectors, of claim 1, selected from the group consisting of polished sheet metal, metal coated plastic, and metal coated glass.

4. A method of focusing downlight of a fluorescent hanging light fixture consisting of:

a—elongated light reflectors over each elongated fluorescent light tube, b—said elongated light reflector extending the length of said elongated fluorescent light tube, c—cross section of said elongated light reflector comprising an arc straddling said elongated fluorescent light tube and at a space of 0.375 times diameter of said elongated fluorescent light tube from said elongated fluorescent light tube, d—said arc of said elongated light reflector having a radius of 0.875 times the diameter of said elongated fluorescent light tube and said arc ranging from 120° to 160° and, e—sides of said elongated light reflector, tangent at each end of said arc range of said elongated light reflector f—a single ballast mounted in a ballast channel assembly and, g—a plurality of said elongated light reflectors and said elongated fluorescent light tubes mounted in said fluorescent light fixture.

5. A fluorescent elongated tube light fixture comprising:

a—a plurality of elongated light reflectors and each end of said elongated light reflectors attached to socket mount/wire raceway arms, b—two of said socket mount/wire raceway arms attached, one on each end perpendicular to ends of ballast channel assembly, c—a single ballast mounted in said ballast channel assembly, d—light tube sockets, for a plurality of elongated fluorescent light tubes, mounted on said socket mount/wire raceway arms, at each end of said plurality of said elongated light reflectors in the concave side of said plurality of said elongated light reflectors, e—said plurality of said elongated fluorescent light tubes inserted into said light tube sockets, in the concave side of said elongated light reflectors, f—said elongated light reflectors, fitting over said elongated fluorescent light tubes, said elongated light tubes having a diameter of D, then the radius R, of the bend of the cross section of said elongated reflector is D×0.875, g—said arc at said bend of said elongated light reflector is equal to 120° and sides of said elongated reflectors are tangent to the radius at ends of said arc, h—said sides of said elongated light reflectors extend outward to a dimension between said elongated reflector sides equal to 3.25× diameter of said elongated fluorescent light tube, i—the distance between said elongated fluorescent light tube, and said arc of said bend of said elongated light reflector is equal to 0.375× diameter of said elongated fluorescent light tube and, j—distance from bottom of said elongated fluorescent light tube to span line between edges of said elongated light reflector is equal to 0.5× diameter of said elongated fluorescent light tube.

* * * * *